US005203427A

United States Patent [19]

Williams, Sr. et al.

[11] Patent Number: 5,203,427

[45] Date of Patent: Apr. 20, 1993

[54] FIRE ESCAPE LADDER WITH INTEGRAL AIR CUSHION

[76] Inventors: Anthony E. Williams, Sr.; Alonda O. Williams, both of 6 Belmont Ct., Holbrook, N.Y. 11741

[21] Appl. No.: 883,677

[22] Filed: May 15, 1992

[51] Int. Cl.[5] ..... E06C 1/36

[52] U.S. Cl. ..... 182/129; 182/137; 182/206; 182/194

[58] Field of Search ..... 182/137, 48, 49, 206, 182/194, 196, 129

[56] References Cited

U.S. PATENT DOCUMENTS

| | | | |
|---|---|---|---|
| 3,088,542 | 5/1963 | Johnson et al. | 182/48 |
| 3,489,917 | 1/1970 | Gurol | 200/61.45 |
| 3,603,430 | 9/1971 | Kendall | 182/137 |
| 3,741,584 | 1/1972 | D'Avanzo | 182/49 |
| 3,757,292 | 9/1973 | Sato | 340/52 H |
| 3,848,698 | 11/1974 | Kanbe | 182/137 X |
| 3,901,364 | 8/1975 | Katsube | 193/25 R |
| 4,583,616 | 4/1986 | Baker | 182/49 |
| 4,590,634 | 5/1986 | Williams | 182/2 X |
| 4,813,663 | 3/1989 | Rice | 182/48 X |
| 4,867,275 | 9/1989 | Islava et al. | 182/206 X |
| 4,991,682 | 2/1991 | Kuntz | 180/282 |
| 5,052,065 | 10/1991 | West | 182/137 X |

FOREIGN PATENT DOCUMENTS

| | | |
|---|---|---|
| 31056 | 9/1910 | Sweden . |
| 1434366 | 5/1976 | United Kingdom . |

*Primary Examiner*—Alvin C. Chin-Shue
*Attorney, Agent, or Firm*—Alfred M. Walker

[57] ABSTRACT

A portable fire escape ladder with an inflatable air cushion is provided. The ladder has an upper window sill engaging portion, and a plurality of frame members interconnected with rungs. The air bag is inflated by propellant from a trigger operable propellant source, for decelerating a person prior to alighting on the ground.

9 Claims, 3 Drawing Sheets

FIRE ESCAPE LADDER WITH INTEGRAL AIR CUSHION

The present invention is disclosed in disclosure document #299-130 dated Jan. 16, 1992 and entitled "SAFE-S-CAPE".

Escaping from a burning house or other building often presents a problem if one is above the first floor. For example, if one is on the first floor, it is relatively easy to jump out of the window or race through a doorway to make it to safety; however, if one is on the second or third floor, jumping to the ground is out of the question for safety reasons. Although one can use a ladder to climb down, it is all too easy to slip on the ladder in the haste to descent to the ground.

The present invention offers a ladder and inflatable air bag that increases one's chances of escaping a fire without injury. It is made of strong, durable materials and is easy to use.

The prior art generally reveals fire escape ladders and chutes, including U.S. Pat. No. 4,650,034 of D'Avanzo, U.S. Pat. No. 3,901,364 of Katsube, and U.S. Pat. No. 4,583,616 of Baker. In addition, U.S. Pat. No. 3,489,917 of Gurol, U.S. Pat. No. 3,741,584 of Arai, and U.S. Pat. No. 3,757,292 of Sato, disclose inflatable air bags for automobiles. While the D'Avanzo U.S. Pat. No. 4,650,034 has a chute and a separate air bag, none of the prior patents disclose literally a foldable fire escape ladder with an integral CO2 actuated air bag cushion, wherein the air bag's inflation is triggered by a handle at the upper end of the ladder.

The present invention includes a large, flexible fire escape ladder with rungs and foldable interconnected side supports, which side supports are made from metal tubing, while the rungs of the ladder are preferably made from metal or braided rope.

The top of the ladder has strong metal or plastic hooks that hook over a window sill to engage the ladder with the window sill. The bottom of the ladder is attached to a large, inflatable air bag made of rubber or nylon engagable with the ground. The air bag is inflated by operating one or more nylon pull cords, threaded through one or both side supports of the ladder to a hand operated trigger mechanism at the top of the ladder to produce a flow of gas to inflate the air bag.

When fully constructed, the ladder preferably measures approximately two to three stories in height. The integral air bag preferably measures five feet in length, four feet in width and six inches in thickness, when inflated.

To use the present invention, the user opens a window, attaches the hooks to the sill and throws the ladder and air bag cushion to the ground. The user uses the trigger mechanism to then pull a propellant inlet source, such as pull cords, to inflate the bag, waits for the air bag to become fully inflated, climbs out of the window and descends the ladder to safety.

After use, the air bag is deflated and ladder folded for storage.

Although the aforegoing represents the preferred embodiment, it is submitted that variations in size are possible. For example, the ladder can be made in several sizes, such as for two-story and three-story structures.

It should be noted, however, that the basic form and function of the present invention may be varied or modified so that the application and use of present invention can be produced in various modifications without departing from the size of the present invention.

The present invention provides a reliable means of rapidly inflating the bag. Typically, a propellant such as carbon dioxide is used, since it allows the bag to inflate rapidly and is packaged in a pressurized container that is incorporated into the air bag. Furthermore, a typical CO2 canister measures approximately $\frac{1}{2}''$–$\frac{3}{4}''$ in diameter, so that it fits within the diameter of the side supports of the ladder. The container is connected to one or more pull cords, and a trigger operable handle or handles made of plastic or metal is added to the opposite end of the pull cord to enable the user to start the inflation process.

The air bag is made of flexible, shock-absorbant material that unfolds rapidly and provides an effective cushion without rupturing from the impact of the user. The material used is able to cushion the impact of a child or adult and has an effective range of at least 30 to 250 pounds. It may be made of different types of nylon and rubber or similar materials best suited for the technical requirements of the present invention.

Metal components of the present invention are produced from stainless steel, galvanized steel or aluminum. Stainless steel or galvanized steel are the preferable materials to use, since they are stronger and more durable than aluminum.

The rope in the rungs of the ladder can be replaced by lengths of stainless steel or galvanized steel chain.

The metal treads on the ladder may be optionally covered by a thin layer of neoprene rubber. The rubber cover provides better traction as the user is descending the ladder and helps to prevent slipping.

The concept of an escape ladder and air bag prevents users from suffering injury when escaping from a burning building is a useful answer to the need for a more effective, easy-to-use style of fire escape.

DETAILED DESCRIPTION OF THE PREFERRED EMBODIMENT

Figure 1:
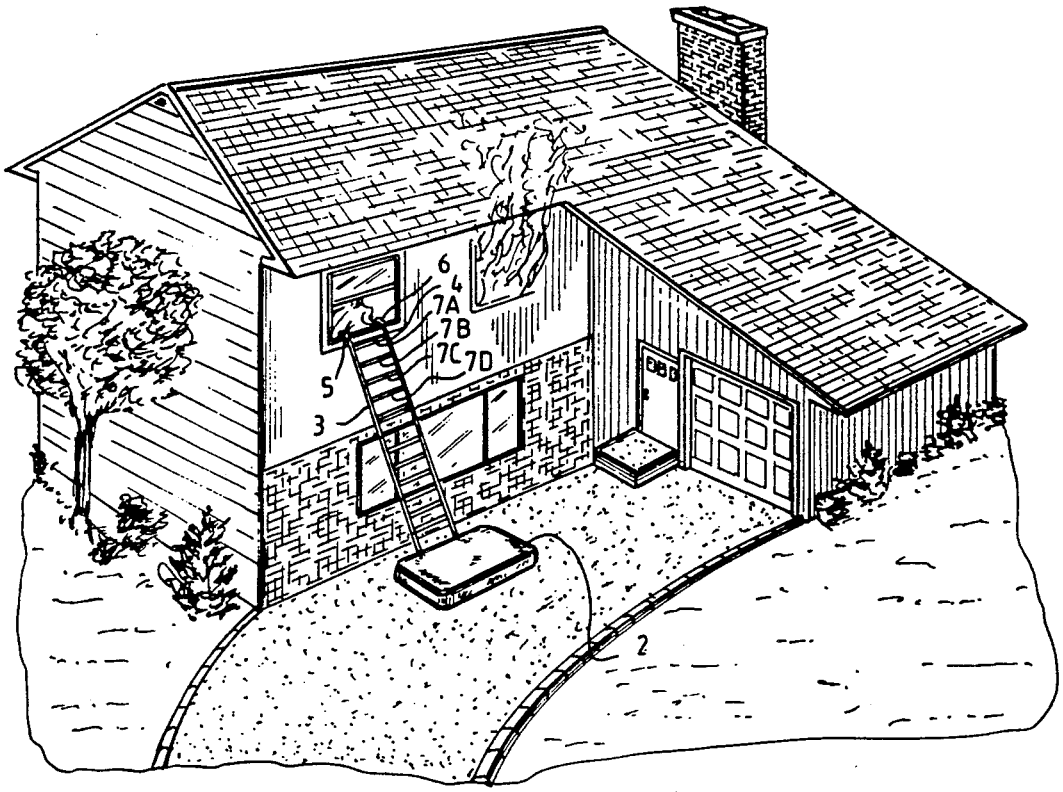
FIG. 1 is a perspective of the ladder of the present invention in use.
Figure 2:
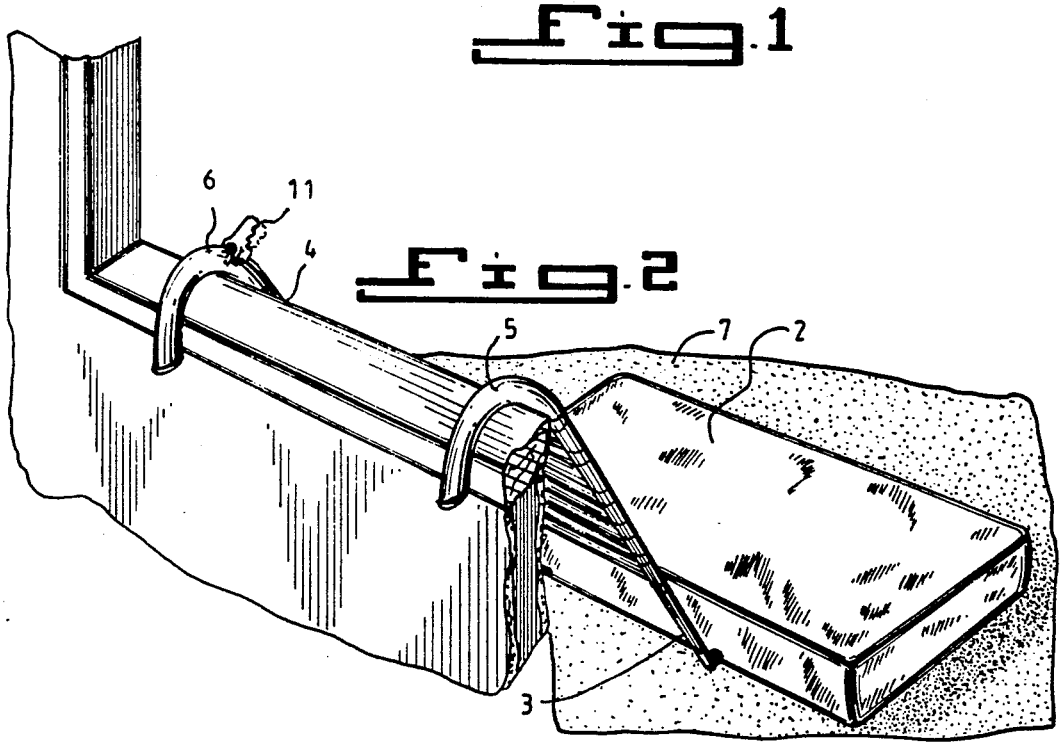
FIG. 2 is a close-up perspective of the ladder as in FIG. 1.
Figure 3:
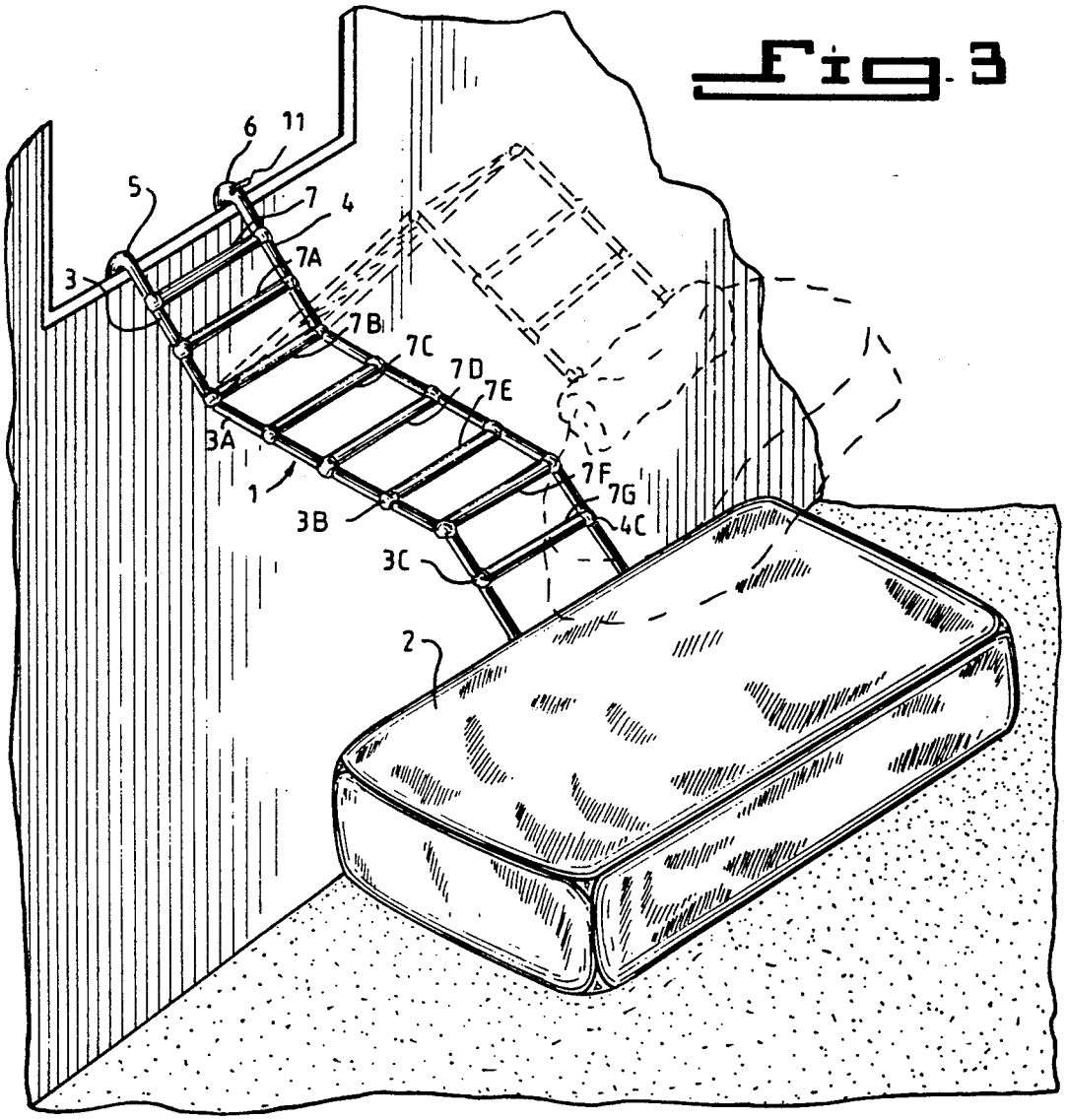
FIG. 3 is a perspective of the ladder in use, showing it being activated in dotted lines
Figure 4:
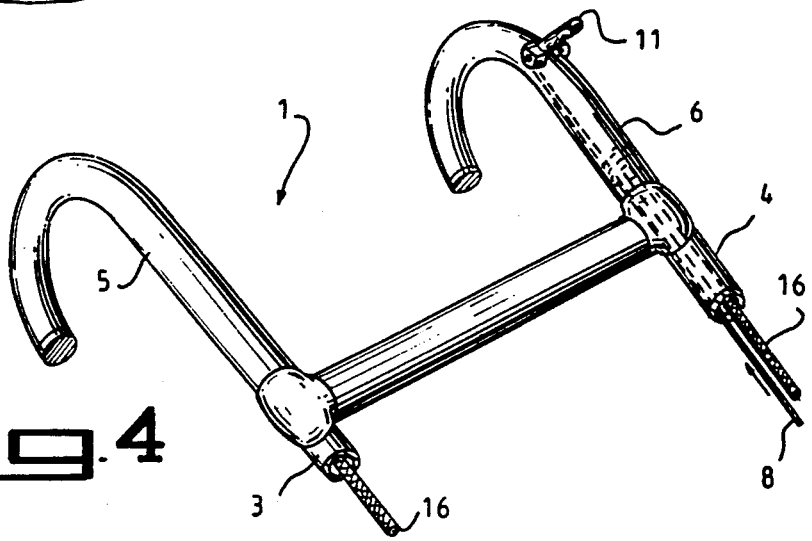
FIG. 4 is a close-up of the ladder as in FIG. 1.
Figure 5:
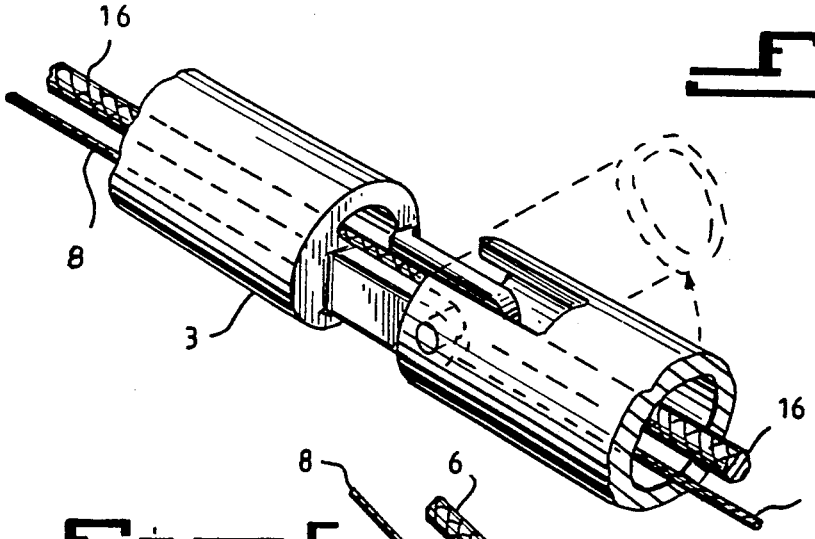
FIGS. 5, 6 and 7 are close-up perspective views in partial sections of the trigger portion of the ladder as in FIG. 1.
Figure 6:
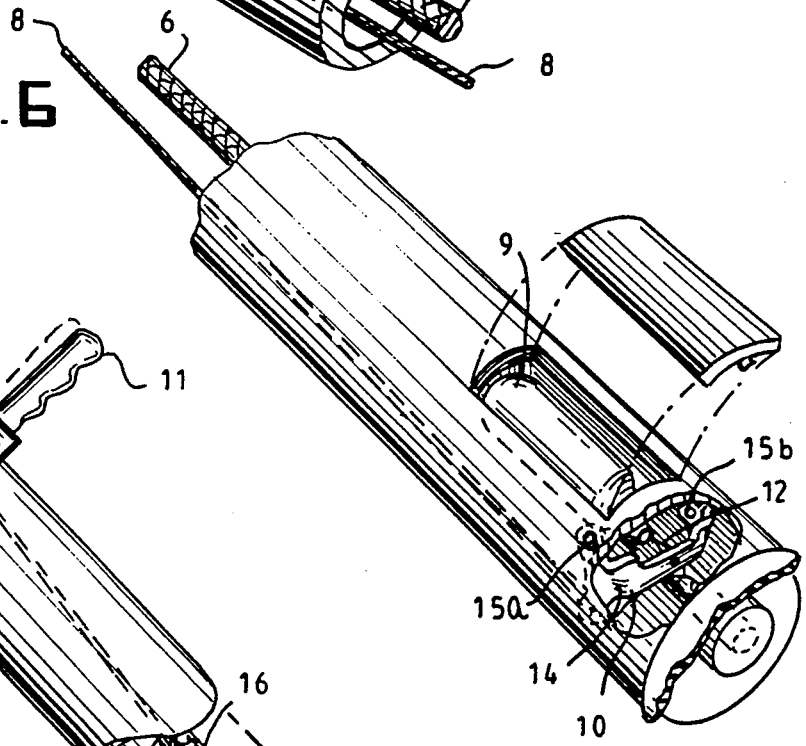
Figure 7:
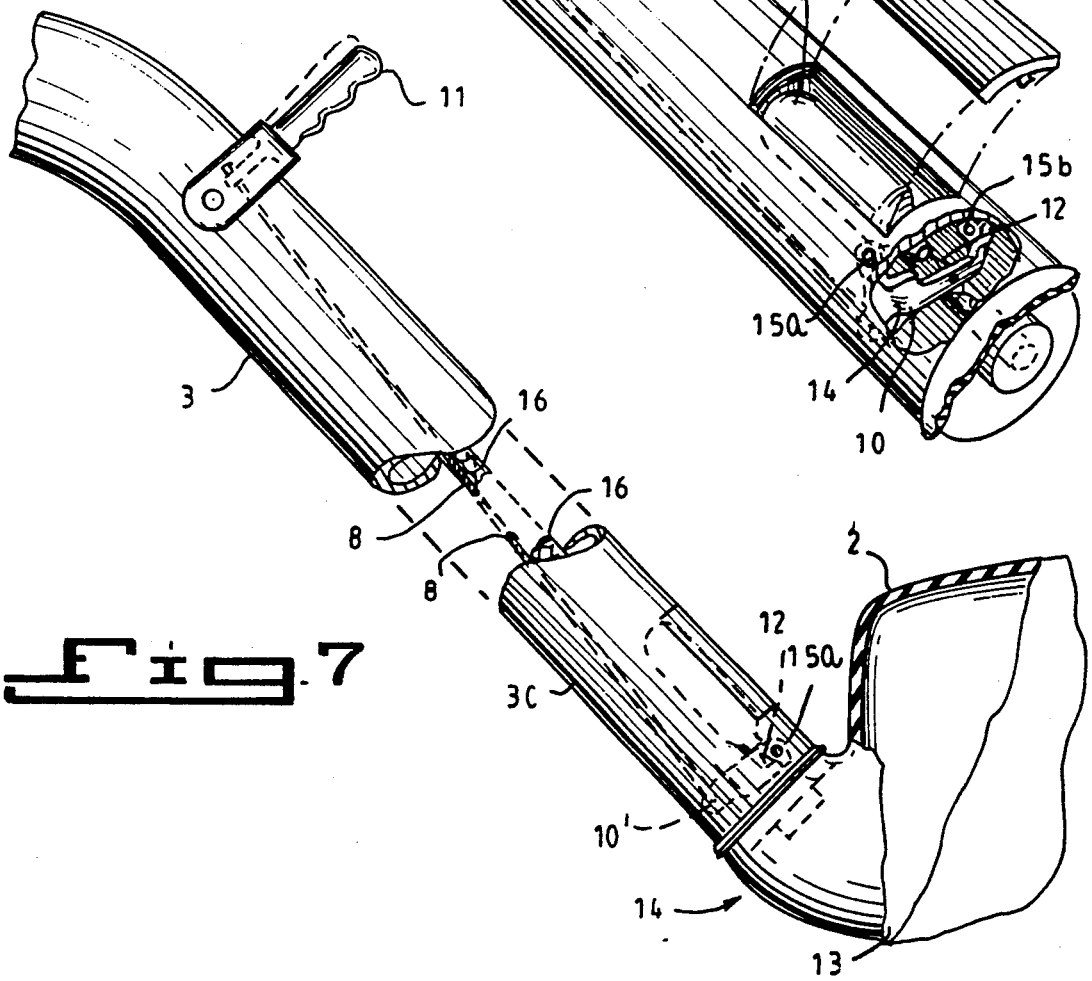

This present invention is a specially-designed fire escape ladder 1 with a first upper end and a second lower end and air bag 2 adjacent said second lower end, the air bag 2 used as a safety product in protecting people from injuries when they are climbing from windows during a fire.

The present invention is a special fire escape product used to reduce the risk of injury when one is climbing out an upper window during a fire. The present invention is fabricated using a frame with aluminum tubing, interconnected by rungs such as braided rope, and a propellant source, such as a CO2 canister. It includes preferably aluminum side support members, such as 3, 3A, 3B, etc. and 4, 4A and 4B, etc., used for the fire escape support mechanism with upper window sill engaging portions, such as hooks 5 and 6 at the top used for hooking to the window sill. The ladder includes a plurality of lateral foldable frame members, such as aluminum side support tube poles 3, 3A, 3B, 3C and 4, 4A, 4B, 4C, which are interconnected with rung members 7, 7A, 7B, 7C, 7D, 7E, etc, such as metal members or braided rope pieces, at intervals down the side support members 3, 3A, 3B, 3C and 4, 4A, 4B, 4C forming ladder 1. The bottom of ladder 1 is integrally fabricated with a large inflatable support means, such as air bag 2, that is adjacent to the ground and inflated during use. The air bag 2 is folded when not in use and has a trigger cable cord 8 threaded through the side support members 4, 4A, 4B, and 4C to an activating means for the air bag propellant inlet source canister 9, with a means to direct the flow of CO2 to air bag cushion 2. Then cable cord 8 is pulled by activating trigger handle 11 in a rearward pull at the window after the ladder 1 is unreeled; this cable cord mechanism activates pin activating structure 10, including pin lever 14, which pin lever 14 rotates about an axis perpendicular to the axis of cable cord 8, which cable cord 8 is responsive to a rearward movement of trigger handle 11. As the handle 11 is pulled rearward, the bottom of handle 11 is thrust forward as handle 11 rotates, thereby causing cord 8 to move forward, and to cause pin lever 14 and penetrating pin 12 to rotate, which pin 12 punctures the CO2 canister 9, and produces a flow of gas, to inflate air bag cushion 2 at the bag coupling 13. When cable 8 pulls pivotable activating pin structure 10 to activate CO2 cartridge 9, as the pin 12 is moved by pin lever 14 which is rotatable about hinges 15*a* and 15*b*. Preferably, air bag 2 measures approximately five feet long by four feet wide and 16 inches thick. The air bag 2 is held close to the bottom of the ladder 1 with fasteners, such as bag coupling 13, attached to the bottom of ladder frame tubings 3C and 4C.

After air bag 2 is inflated, air bag 2 alleviates many serious injuries due to falls when a person decends down escape ladder 1.

To maintain the integrity of the section of the ladder 1, an internal rope 6 connects the top portion of ladder 1 to the bottom portion of the ladder 1, which bottom portion has an outlet means such as bag coupling 13, through which the propellant flows to inflate air bag cushion 2.

In summary, the present invention includes a safety escape ladder to permit persons to escape from a burning building. The ladder has an upper window sill engaging portion, a plurality of frame members interconnected by rungs, and an inflatable support means for maintaining a second end of the ladder adjacent to the ground. A trigger inflatable support means, such as a movable, puncturable pin, is provided within a hollow frame member to open a source of inflatable gas and direct its flow into the air bag, thereby inflating the air bag.

Other modifications may be made to the present invention, without departing from the spirit and scope of the appended claims.

I claim:

1. A safety escape ladder for permitting persons to escape from burning buildings and the like to the ground comprising a ladder having an upper window sill engaging portion, a plurality of frame members interconnected with rungs and a lower second end portion, an inflatable support means for maintaining said lower second end portion adjacent the ground; a propellant source member disposed to said inflatable support means, said propellant source connected to a trigger, said propellant source operable of producing a flow of gas to said inflatable support means to accelerate inflation of said inflatable support means; an outlet located at an outlet point along said ladder, said outlet disposed to said inflatable support means, for directing a flow of said propellant to said inflatable support member for decelerating a person prior to alighting on the ground, said support means and said ladder being integrally connected, and said trigger attached to said upper window sill engaging portion for permitting said propellant to be propelled into said inflatable support means.

2. The ladder as recited in claim 1 in which said source of propellant includes a CO2 reservoir and a pumping means capable of puncturing said CO2 reservoir, said pumping means connected to said outlet for propelling inflatable CO2 gas to said inflatable support means.

3. The ladder as recited in claim 2 in which said ladder includes a cord for opening and activating said propellant source for inflating said inflatable support means.

4. The ladder as recited in claim 1 further comprises a connecting cord for connecting said trigger and said propellant source for said inflatable support means, said connecting cord inserted through an opening in said ladder frame members.

5. The ladder as recited in claim 1 further comprising said inflatable support means being disposable to the ground, adjacent to said lower second end portion of said ladder.

6. The ladder as recited in claim 1 wherein said ladder comprises foldable interconnecting sections.

7. The ladder as recited in claim 1 in which said ladder comprises a plurality of ladder sections hingedly attached to each other of said ladder sections.

8. The ladder as recited in claim 1 wherein said propellant source is a CO2 canister.

9. The ladder as recited in claim 2 in which said pumping means includes a pin puncturable into said CO2 canister, said CO2 canister capable of releasing CO2 gas from said canister, said pin responsive to a rotatable movement of a pin lever within said openings in said ladder frame members, said lever rotatable about hinges at either side of an interior wall defined within said ladder frame member, said pin lever movable in response to said connecting cord connecting said trigger and said inflatable support means.

* * * * *